United States Patent [19]

Arvidsson

[11] 3,987,219

[45] Oct. 19, 1976

[54] METHOD FOR IMPREGNATION OF WOOD BY PRESSURE SURGES DURING IMMERSION

[76] Inventor: Ewald Arvidsson, Dannemoragatan 10, 113 44 Stockholm, Sweden

[22] Filed: Sept. 20, 1973

[21] Appl. No.: 399,152

[52] U.S. Cl. ..... 427/297; 21/7; 427/331; 427/348; 427/369; 427/440

[51] Int. Cl.[2] ..... B05D 3/00; B05D 3/04

[58] Field of Search ..... 117/113, 116, 119, 57, 117/147, 59; 21/7; 427/351, 297, 331, 348, 369

[56] References Cited

UNITED STATES PATENTS

| | | | |
|---|---|---|---|
| 2,210,832 | 8/1940 | Bright | 117/57 |
| 2,786,784 | 3/1957 | Henriksson | 117/119 |
| 2,931,737 | 4/1960 | Thornton | 117/119 |
| 3,137,607 | 6/1964 | Goldstein et al. | 117/119 |
| 3,233,579 | 2/1966 | Arvidsson | 117/119 |
| 3,467,546 | 9/1969 | Page et al. | 117/116 |
| 3,632,409 | 1/1972 | Barnett | 117/113 |
| 3,671,299 | 6/1972 | Barnett | 117/116 |
| 3,677,805 | 7/1972 | Barnett | 117/116 |
| 3,801,360 | 4/1974 | Dahlgren | 117/119 |

FOREIGN PATENTS OR APPLICATIONS

| | | | |
|---|---|---|---|
| 227,747 | 5/1971 | Sweden | 117/59 |
| 1,203,299 | 8/1970 | United Kingdom | 117/59 |

*Primary Examiner*—Harry J. Gwinnell
*Attorney, Agent, or Firm*—William R. Woodward

[57] ABSTRACT

Unit loads of wood, surrounded by a small quantity of liquid, are impregnated in sturdy vessels provided with a cover. After or during an impregnation period under vacuum, the impregnation is completed by subjecting the liquid and the wood to pressure surges or impacts of such an intensity that the wood is deformed in the direction of length of the fibers or in the radial or tangential direction thereof within a range between the average pressure causing breakdown of the wood material and one-third of that average pressure. Intensity of pressure surges increases as the vessels are filled with impregnation liquid. Pressure waves may be produced by means of either compressed air, steam or explosive gas. A connecting chamber is provided for preparation and storage of the impregnation liquid.

12 Claims, 16 Drawing Figures

Figure 1:
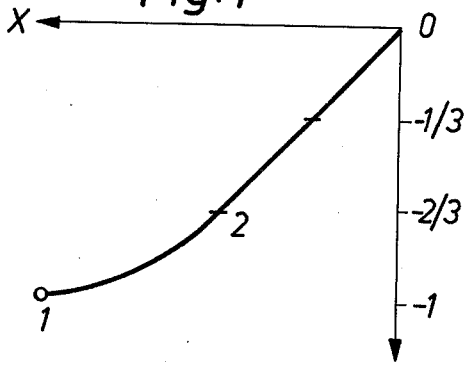

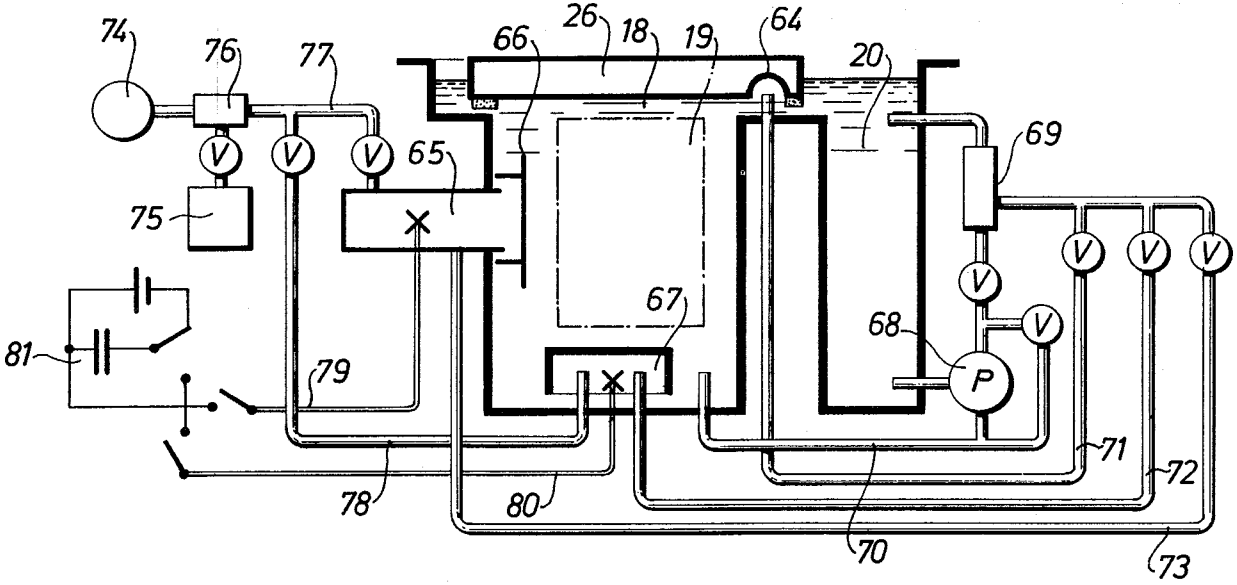
V
V
V
V
V
P
V
V
V
V

METHOD FOR IMPREGNATION OF WOOD BY PRESSURE SURGES DURING IMMERSION

This invention relates to methods and apparatus for impregnating wood to retard or prevent rot.

If it is desired to impregnate wood against rot in a durable manner, every cell in the wood must be reached by the impregnation medium which makes the cell resistant to the rot fungi which otherwise would find their food there. One method of achieving this result is to let suitable salts dissolved in water be fixed in the walls of the cells. Basic inventions concerning vacuum-pressure processes for impregnation were made already more than a hundred years ago. The invention according to Swedish Pat. No. 227 747 was the first to provide an effective and inexpensive arrangement for such impregnation. It has made impregnated wood easily accessible for small consumers of such material.

New progress in vacuum impregnation is dependent on the possibility of shortening the time required for the process, of building inexpensive arrangements and of adjusting the arrangements to modern transport facilities in order to make it possible to handle and distribute suitably standardized wood units economically. In this connection attention should be paid, inter alia, to the dimensions of the platform of the trucks, especially the width thereof. Furthermore, it is an object of the present invention to improve conventional impregnation methods so as to be able to introduce impregnation liquids into those parts of the cells of the wood which cannot be impregnated according to known methods.

This invention is an improvement of the process as well as the arrangement according to Swedish Pat. No. 227 747. According to this patent the wood is submerged in an impregnation liquid and air contained in the cells is extracted by a high vacuum, which is produced by a jet of liquid pump which is connected to the distribution pupm for the impregnation liquid.

The new process according to the present invention is mainly characterized in that after or during the vacuum period the impregnation is completed by subjecting the liquid and the wood to pressure surges or impacts of such an intensity that the wood is deformed in the direction of length of the fibers of the wood or in the radial or tangential direction thereof within a range between $-\frac{1}{3}$ and $-1$ of the diagram showing the compressibility of wood of various types at pressure treatment. The intensity of the pressure surges imcreases successively within the said range as the cells are filled with impregnation liquid, in exceptional cases even below the deformation limit at about $-\frac{2}{3}$. The surges reduce the pore volume of the wood which is not occupied by the liquid and therefore at each new surge the liquid is rapidly forced further and further into the wood.

The impregnation arrangement or plant is constructed for treatment of parallel epipedic wood packages, i.e. so-called unit loads, which are surrounded by a small quantity of liquid in an impregnation vessel provided with a cover. The vessel and the cover, which are preferably made of reinforced concrete, are so constructed that the vessel can absorb rapid pressure surges or impacts of considerable magnitude without being a pressure vessel of ordinary construction. The cover of the vessel is heavy and loosely resting on a tight sealing member below the highest level of the liquid in the store tank. By changing the air pressure in airtight bags which are anchored in the bottom or the walls of the store tank the level of the liquid in the store tank can be raised or lowered. The store tank mounts through a sector, i.e. an exhaust passage above the impregnation tank, into a ditch which is formed between the cover and the raised edge of the impregnation chamber. The cover is provided with lifting means, for instance a shackle.

As the pressure surges preferably are outside the range of proportionality of said diagram the very good impregnation obtained is possible at a cost of only unimportant changes of the strength of the structure of those parts of the cells which in worked wood always are deep under the surface of the wood. To improve on the solution of the transport problem the wood units generally are transported to and from the plant and inside the plant by means of fork-lift trucks, which are also used for lifting the cover on and off the vessel. Therefore, the cover shall have practically the same weight as the impregnated wood package. The merit of the arrangements according to this invention is, among other things, that the operation of the devices results in increased time saving. If a dry piece of wood is placed in a vessel containing impregnation liquid without special treatment, i.e., is subject neither to vacuum nor to pressure, the wood will be satisfactorily impregnated in about one year. The known plants have with varying results combined vacuum- and pressure treatment in order to reduce the process time.

Figure 2:
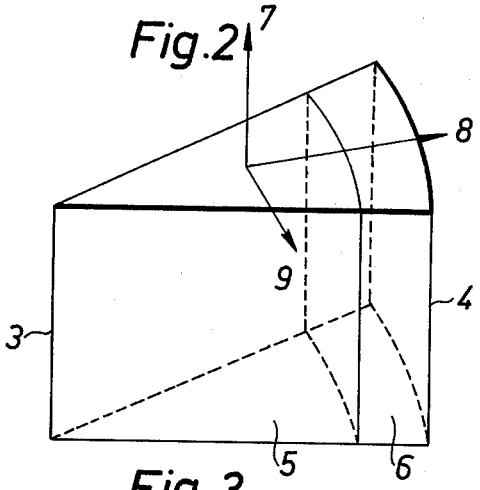
Figure 3:
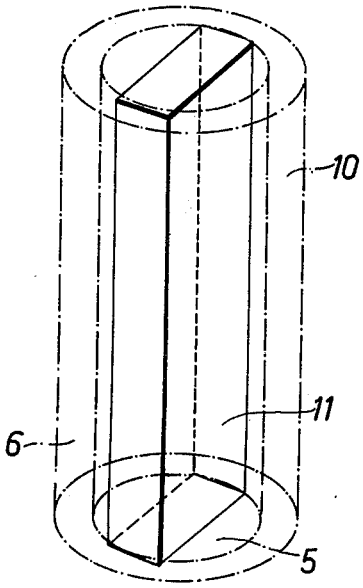
Figure 4:
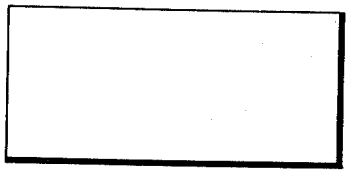
Figure 10:
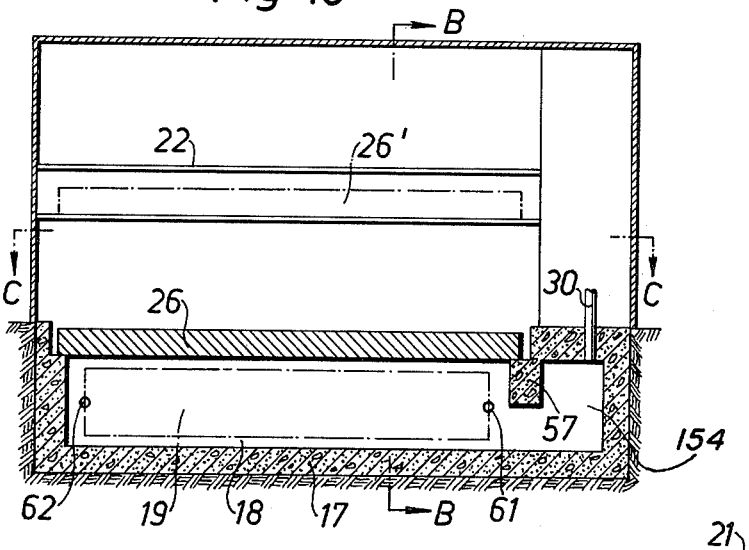
Figure 11:
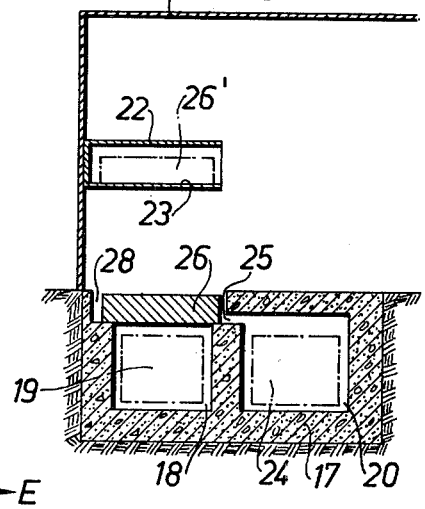
Figure 12:
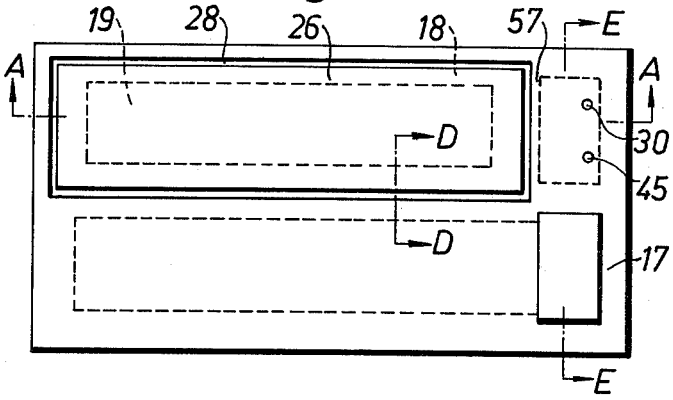
Figure 13:
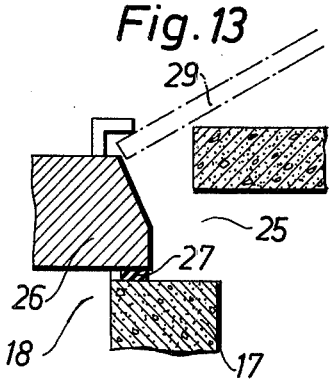
Figure 14:
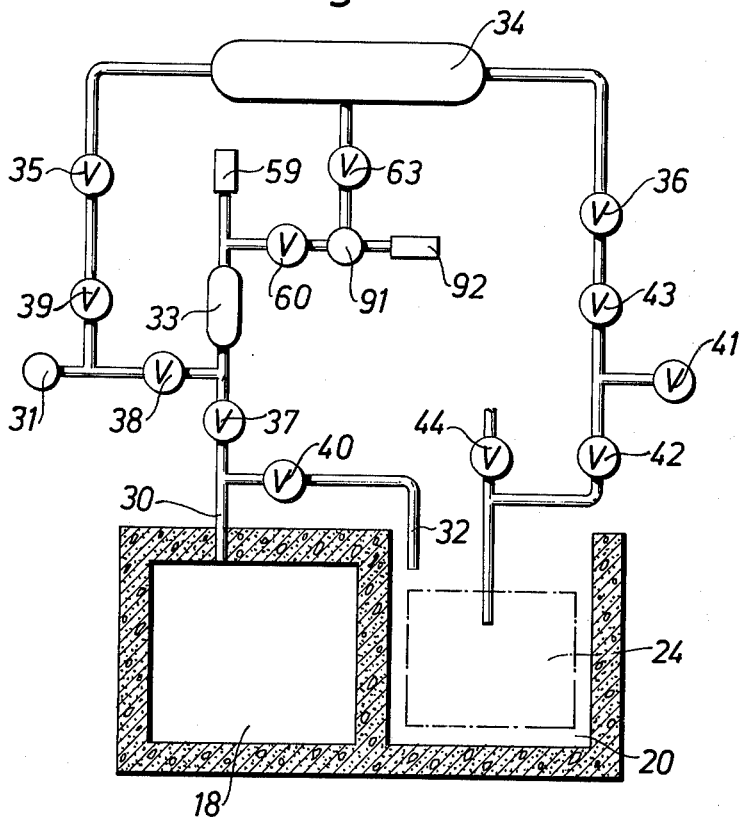
Figure 15:
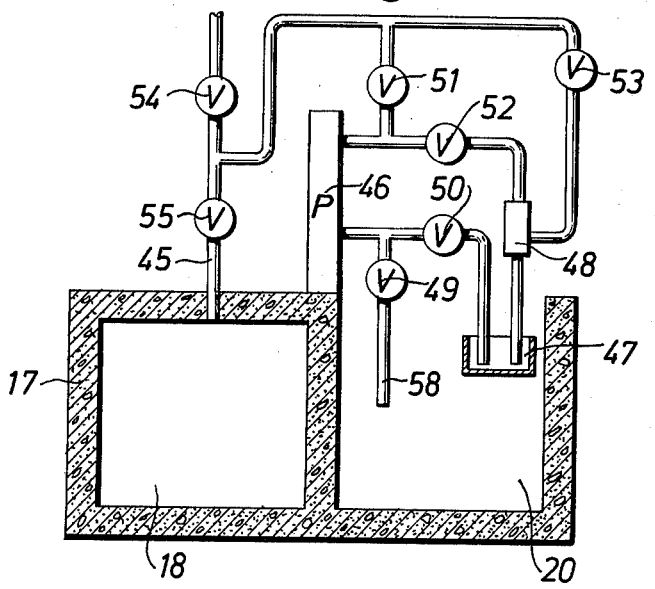

The invention will be described hereinbelow in greater detail with reference to the drawings, in which FIG. 1 shows a compressibility curve for wood;

FIG. 2 a wedge-shaped section through a part of a tree trunk;

FIG. 3 is a piece of another tree trunk in the longitudinal direction;

FIGS. 4–9 a section through a plank at different stages of impregnation;

FIGS. 10–11 show schematically and in two mutually perpendicular vertical sections, AA respectively BB, an embodiment of an arrangement or plant for carrying out the process according to the invention;

FIG. 12 a plane section along the line CC of the same plant as shown in FIGS. 10–11;

FIG. 13 a section along a line DD through a detail of the plant according to FIGS. 10–12;

FIG. 14 an example of a compressed air equipment in section EE according to FIG. 12, which can be used in connection with the process according to the invention;

FIG. 15 an example of a liquid pump equipment in the same section EE according to FIG. 12, which can be used in the process according to the invention and FIG. 16 a further embodiment of an arrangement or plant for carrying out the process according to the invention and in which the pressure surges are created by detonation of explosive gas.

FIG. 1 shows a compressibility curve for pressure treatment of wood, for instance pine. The x-axis represents the deformation of the material in conventional measuring unit, and the y-axis represents the force per unit of surface in conventional units used for the compression. Point 1 shows the point of break-down of the material and point 2 the point, where the wood springs back without having been damaged by the deformation. FIG. 2 shows a wedge-shaped section of a tree-trunk, where 3 is the longitudinal central line (pitch)

and 4 the bark of the trunk. The wood consists of a core 5 which is dead and surface wood 6 which was biologically alive when the tree was felled. The arrow 7 shows the direction of the fibers of the wood, while 8 and 9 show directions perpendicular to the direction 7. FIG. 3 shows a piece of another tree-trunk 10 with a plank 11 cut out in the longitudinal direction of the trunk.

Figure 5:
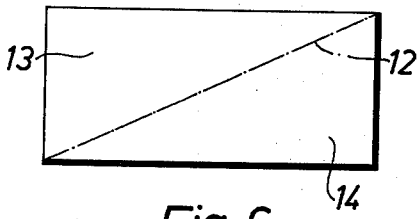
Figure 6:
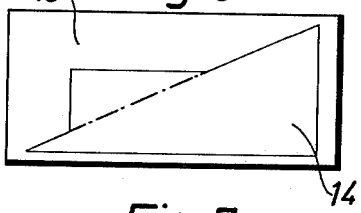
Figure 7:
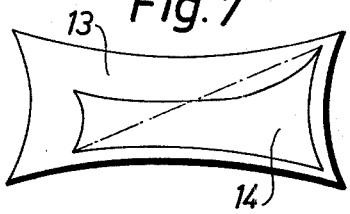

FIGS. 4–9 show a quadrangular section through a plank at different simplified stages of impregnation. The section is taken perpendicular to the fiber direction of the wood. In FIG. 5 the line 12 shows schematically the limit between the sapwood 13 and the heartwood 14 of the wood. The treatment has then started at a vacuum of $-1$ kp/cm$^2$ and the air has been pressed out of the cells of the sapwood 13. FIG. 6 shows to what extent the impregnation liquid has penetrated into the wood at atmospheric pressure after the end of the vacuum period. FIG. 7 shows the plank 11 subjected to a strong deformation at a pressure of for instance about $+30$ kp/cm$^2$.

Figure 8:
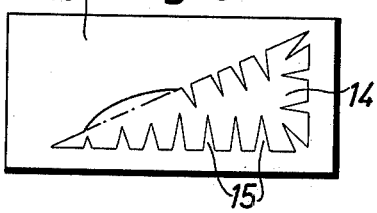
Figure 9:
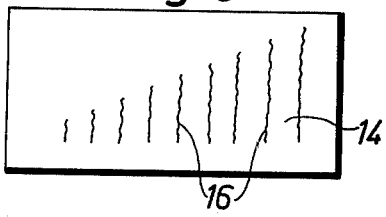

FIG. 8 shows the plank 11 as it has sprung back and where the impregnation liquid by a suction effect has further penetrated into the sapwood 13 and the heartwood 14. The arrows 15 represent so called core breakthrough in the heartwood 14. FIG. 9 is a schematic picture of the plank 11, where the lines 16 indicate the damages which may appear in the heartwood if the pressure has been exerted on the wood below the limit of proportionality, i.e. below the limit where the deformation of the material caused by the pressure does not completely spring back (from point 2 and downwards in FIG. 1).

The embodiment example chosen in the description relates to a process in which the pressure waves are produced by means of compressed air. The impregnation plant according to FIGS. 10–15 consists according to FIGS. 10–11 of a box 17, for instance of concrete, which is dug into the ground and has a chamber 18 for impregnation of unit loads of wood 19, a chamber 20 for prepartion and storage of the impregnation liquid and a house 21 with two horizontal shelves 22 and 23. The level of the liquid in the chamber 20 can be raised or lowered by means of an airtight, inflatable bag 24 which is anchored in the floor or in the walls. The transport of large amounts of liquid between chamber 20 and chamber 18 or in the opposite direction occurs through a passage 25. The chamber 18 is covered by a heavy cover or lid 26, which rests loosely on a seal member 27 along the edges of said cover, which seal member in its turn is protected during the process against penetration of air into the vessel by a ditch 28, which is filled with liquid. The cover 26 can be lifted for instance by means of a lever 29.

FIG. 12 shows the plant according to the FIGS. 10 and 11 along the line CC, and FIG. 13 a detail of the plant along the line DD in FIG. 12 which will be described hereinbelow.

FIG. 14 shows schematically a compressed-air equipment for production of pressure surges or impacts on the wood and the impregnation liquid according to the invention. This equipment is connected with the chamber 18 by means of a pipe 30. The equipment mainly consists of a compressor 31, a pipe 32 having a large sectional area and situated directly above the pipe 30 and connected to the container 33 under high pressure and to the container 34 for air under lower pressure. There are two reducing valves 35 and 36 and further valves 37, 38, 39 the latter being used for controlling the compressor air to the reservoirs 33 and 34 respectively. For venting the chamber 18 there is a valve 40. Valves 41 and 42 are provided for protecting the plant against flooding due to possible leakage in valve 43 during periods when the plant is not supervised or monitored. The valve 43 is opened when the bag 24 is to be inflated in order to raise the level of the liquid in the store tank 20. If the valve 44 is opened the air will be let off and the level of the liquid will sink.

As a complement to the plant the compressed-air equipment according to FIG. 14 can be provided with a carburettor 61 for providing explosive mixtures of fuel, which are delivered from the fuel tank 62 and the air container 34. A spark plug 59 is mounted in the container 33.

An embodiment of the liquid pump system for creating vacuum and for transfer of small quantities of liquid is shown schematically in FIG. 15. The system is connected with the chamber 18 by the pipe 45. A liquid pump 46 takes the liquid from the chamber 20 or the box 47 and presses it out either through a jet of liquid pump 48 or through a pipe to the chamber 18. In the system there are valves 49, 50, 51, 52, 53, 54 and 55. The valves 54 and 55 are ball valves, which make it possible at the generation of pressure surges or impacts by means of explosive gas to obtain a straight passage for the venting of the gases of the chamber 18.

In the starting position at the beginning of the impregnation the cover 26 is lifted away and by means of a fork-lift truck the unit load or charge of wood 19, e.g. boards or poles, is sunk down into chamber 18, whereupon the cover 26 is put on and is effective for pressing down the wood into the impregnation liquid. The level of the liquid in chamber 20 is raised by opening the valve 43 so that the bag 24 is inflated until the level of the liquid is in flush with the upper edge of the cover 26. The valve 43 is shut. The pump 46 is started with the valves 49, 52, 53 and 55 open and the valves 50, 51 and 54 closed. The jet of liquid pump 48 starts working and evacuates the air in the wood through the liquid for instance during 15 minutes. The valve 54 is opened and air rushes into chamber 18. At the same time the cover 26 is lifted once again by the lever 29, and a large amount of liquid rushes into chamber 18 and is absorbed by the wood within a minute by action of the atmospheric pressure. The cover 26 is put down again.

The compressor 31 has produced an air pressure in the container 33 of the order of 30–50 atmospheres above the atmospheric pressure, the capacity of said container being matched to the size of the impregnation equipment, and through the reducing valve 35 a pressure in the container 34 of the order of 6–10 atmospheres above the atmospheric pressure. The valves 38 and 40 are closed and the valve 37 is opened. Due to this the pressure is increased in the liquid which suddenly completely fills the chamber 18 with a limited quantity of air having a pressure of 30–50 atomspheres above the atmospheric pressure and rushes into a covered chamber 154 (FIG. 10), a pressure wave being thus generated which propagates with the velocity of sound and reaches the one end surface 61 of the wood package 19 (FIG. 10), whereupon the pressure propagates with a velocity which is three times as great through the wood as through the liquid. The pressure wave enters into the liquid at the other end surface 62 of the package and is reflected against the adjacent end wall of the chamber 18. At the other end of the chamber there is an extension (wall) 57, the purpose of which is to extend or increase the way for the pressure wave and consequently the time for lifting the cover 26 by the pressure wave.

The chamber 18 is so designed, that it is prepared for truck handling of wood packages (unit loads) having a width of preferably 1.2 meter, which corresponds to half the width of an ordinary type of truck platform. As a result the wood in chamber 18 is orientated horizontally in its longitudinal direction. The wood is then in a correct position for the described pressure wave treatment. The dimensions of the chamber can be varied for adjustment to the dimension of other transport vehicles such as, for instance, railway trucks.

As the wood has different compressibility properties in its longitudinal direction and in a direction perpendicular to the fibers, the wood is acted upon in a manner favourable for this rapid impregnation as the wood at the treatment first becomes shorter in the longitudinal direction and thicker, whereupon the pressure wave compresses the wood in a direction perpendicular to the fibers on a more powerful way, so that the volume of the wood is reduced to a relatively large extent, the wood immediately thereafter being permitted to expand in a completely re-established atmospheric pressure as the pressure wave has reached the heavy, unattached cover 26 and has had time enough for lifting this cover.

The weight of the cover is adjusted to the lifting power of the truck with which the wood packages are to be handled, for instance about 10 ton, and at the same time the cover must be capable by its own weight to provide the required packing pressure of 700–800 kg per running meter packing.

As to the duration of the treatment at the impregnation it should be pointed out that the known impregnation plants operate with a continous pressure between 7–16 atmosphere above atmospheric pressure. In the fine pipe or capillary system in the cells of the wood in which the impregnation liquid shall be transported to the smallest parts of the wood, the impregnation time is prolonged in two ways. Firstly, the cell mass already occupied by liquid is compressed, and, secondly, the time-dependent swelling of the wood is influenced. In the procedure according to the present invention a shorter process time is attained, firstly because the liquid can pass without hindrance into the outer parts of the wood when it is in a completely unloaded condition, i.e. at atmospheric pressure (FIG. 6), and, secondly, because it can pass before the cell substance has had time to swell to the same extent as in the slower process according to the older methods. Since, according to the invention, the liquid is pumped shock-wise into the wood, the cell ducts having the largest dimensions (resin ducts) become accessible to transport of liquid, because the impregnation agent which is often somewhat acid dissolves the existing amounts of resin and washes them off. In a low or constant pressure treatment as according to known methods the resin is compressed to form a blocking plug preventing complete impregnation.

When the shock generated in the liquid by the quantity of air rapidly rushing out from the container 17 has ebbed away the air flows up into the chamber 154 (FIG. 10) which is limited in its upper right part by the partition wall 57. This wall, as mentioned above, has a delaying effect on the lifting of the cover. The air cushion at the top of the chamber 154 is pressed out because the liquid pump 46 (FIG. 15) which was started with the valves 49, 51 and 55 open is replaced by liquid. The chamber 154 is filled with liquid as flowing starts in the pipe 59. The process is thereafter repeated.

The described pressure surges or impacts can also be produced in a purely mechanical way, for instance, by drop-hammer impacts on a piston in a cylinder filled with liquid and communicating with the liquid-filled space in the vessel 18. The pressure waves can also be generated by means of steam or be completed with detonations. In such case the device according to FIG. 14 can be completed with a carboretter 61, a valve 60, a fuel tank 62, and a further valve 63. The pressure surges in the liquid are generated by the detonation of an explosive gas mixture in the container 33, or, alternatively, in the container 33 and the chamber 154. The detonations are initiated by means of a spark plug 59.

The level of the liquid in chamber 20 is regulated or controlled, as mentioned above, by an inflatable bag 24 which can be filled with air from the container 34 through the reducing valve 36 and the valve 43. The arrangement with the valves 41 and 42 is a safety measure against flooding which may be caused by possible leakage in valve 43. The bag 24 is vented through the valve 44.

After the wood package 19 (FIG. 10) has been subjected to the number of pressure surges or impacts required for the impregnation — said number being dependent on the type of wood and on the dimensions of the wood — the cover 26 is lifted by means of a fork truck (not shown) and is placed on the girder 23 (FIGS. 10, 11), whereupon the truck is used to lift the package 19 and place it on the girder 22, where the wood during a new process cycle is permitted to suck up further impregnation liquid on the surface thereof and/or such liquid is permitted to flow off so that the package can be transported to an other local without troublesome dripping. The house 21 serves as a roof and rain shelter and prevents flooding in the plant.

The rapid impregnation is rendered more effective by sending the pressure surges both through the end surface in the direction of the fibers of the wood work (direction 7 in FIG. 2) and/or in directions perpendicular to this direction of the fibers (direction 8 and direction 9 in FIG. 2), in which directions the compressibility of the wood is at a maximum. These pressure surges or shocks can be sent out both alternately one after the other, or simultaneously. When applying alternate treatment as described above, the possibilities are increased of utilizing the newly opened resin ducts in the wood, which in a merely static pressure treatment are clogged by accumulation of resin, so that an effective impregnation is prevented. The pressure surges through the wood in a horizontal working direction and in a vertical working direction from the end wall of the chamber can have the same intensity and speed.

The further developed process results in a shortening of the vacuum period and the time for evacuating the air at the treatment, as well as the pressure period at alternate treatment so that the total process time is shortened significantly.

According to the invention the pressure waves or surges are sent through the end surface of the wood suitably with an intensity of 36 Joules per $dm^3$ wood material. The pressure surge or wave is released during a period of 0.001 second and has a length of 10 cm. As the pressure wave has different velocity in dry wood and in liquid the cells in the wood will first be inflated and then flattened. This influences the ventilating system for enclosed air in the cell in such a way that the duration of the vacuum period of the process can be reduced and the process time is shortened. Hitherto the vacuum period has normally had a duration of about 15 minutes and would not be appreciably reduced by a number of pressure surges having a duration of 1/1000 of a second and propagating with a velocity of the order of 1500 to 4000 meters per second if the cells would be left quite unaffected by said pressure surges. However, since the cell mechanism is in fact affected by said surges so that air entrapped in the cells can more easily escape and be sucked off by the vacuum the vacuum period will be shortened considerably. How the impregnation of the wood in this manner can be carried out in practice will be described more in detail hereinbelow with reference to an embodiment of such a plant shown in FIG. 16 of the drawing.

The components of the plant which are unchanged as compared with the impregnation plants shown in FIGS. 10–15 are denoted by the same reference numerals.

An impregnation chamber 18 is filled with impregnation liquid, into which a wood charge 19 is immersed. A store tank 20 is fundamentally the same as in the embodiment previosly described, but the cover 26 of the chamber 18 is extended in the one lateral direction and is formed with an air bubble collecting cavity 64 at the inner side thereof. The air is evacuated via the cavity by the pipe 71. This quantity of air is kept at a minimum, as it excerts a spring action on the cover when the detonation wave is transmitted through the impregnation liquid and can disturb the normal course of the pressure treatment. In the end walls of the impregnation chamber 18 there are moulded-in cylinder houses 65 with sring-loaded cylinder covers 66 inside the chamber. These covers can resist a vacuum of about −1 kg/cm$^2$ and the plates facing the liquid are so designed that, at the detonation the impregnation liquid offers so great a resistance to the pressure surges that the spring device can return the movable part into its starting position shortly after the detonation.

The explosive fuel mixture is preferably produced by a continuously working compressor 74 which is adapted through an ejector 76 to mix air and combustible gas from a container 75, and to direct it partly through the pipe 77 to the cylinders 65, and partly through the pipe 78 to a box 67 turned upside-down on the bottom of the chamber. The box 67 can also have another shape and can, for instance, consist of angle iron bars forming another profile of the space.

A liquid pump 68 operates an ejector 69 and transfers impregnation liquid through the pipe 70 from the store tank 20 to the impregnation chamber 18. An electric spark causes the gas mixture to detonate in the box 67 in the chamber 18 through the pipe 80 when the chamber 18 is under pressure as well as in the cylinders 65 through the pipe 79 when vacuum prevails. The ignition system common to the two detonation devices is denoted by 81. The gas mixture can, as desired, be detonated through the end walls of the chamber for excerting pressure surges or impacts perpendicular to the fiber direction of the wood 19 or from the end surfaces of the wood in the fiber direction of the wood by means of the device at the bottom of the chamber. This is, of course, dependent on how the wood load 19 is placed in the impregnation chamber. The ignition for the detonation can also occur simultaneously in both directions.

The evacuation of gas from the impregnation chamber after the detonation is effected by way of the ejector 69 which is operative for evaucation and at the same time generates the vacuum in the impregnation chamber 18. The air pressed out of the wood at the detonation is evacuated through a pipe 71 and the cavity 64 of the cover. Air is evacuated from the cylinder houses 65 through a pipe 73 and from the box 67 through a pipe 72.

What I claim is:

1. A method for impregnation of wood in which wood immersed in an impregnation liquid is subjected to pressure steps starting with atmospheric pressure after vacuum treatment evacuating air from the wood cells, the impregnating liquid being absorbed by the wood upon an increase in pressure, characterized in that the wood immersed in said liquid is subjected to short increasing pressure surges of a duration substantially less than one second, the maximum intensity of said pressure surges being such that the wood is compressed to a pressure in the range from one third of the breakdown pressure of the wood to the breakdown pressure of the wood, each such pressure surge being followed by a recovery to equilibrium at substantially atmospheric pressure.

2. A method as defined in claim 1, in which the duration of said pressure surges is about 0.001 second.

3. A method as defined in claim 1, in which the wood immersed in said liquid is subjected to said short pressure surges while said wood and said liquid are contained in a massive container and said pressure surges are initiated at one wall of said container so as to propagate towards and be reflected from an opposite wall thereof, and in which recovery to equilibrium as aforesaid is initiated by the pressure surge reaching a release valving device provided on said container.

4. A method according to claim 1, characterized in that the pressure surges are oriented so as to propagate along the direction of the fibers of the wood.

5. A method according to claim 1, characterized in that the pressure surges are oriented so as to propagate at right angles to the direction of the fibers of the wood.

6. A method according to claim 1, characterized in that the pressure surges are oriented so as to propagate both along the direction of the fibers of the wood and at right angles to said fiber direction.

7. A method according to claim 6, characterized in that the wood is subjected simultaneously to pressure surges in the direction of the fibers of the wood and pressure surges at right angles to said fiber direction.

8. A method according to claim 7, characterized in that the intensity of the pressure surges is the same in both directions.

9. A method according to claim 6, characterized in that the wood is subjected to alternate pressure surges in different directions.

10. A method according to claim 1, characterized in that the pressure surges are generated by pressurized air suddenly introduced into the impregnation liquid.

11. A method according to claim 1, characterized in that the pressure surges are generated by steam suddenly introduced into the impregnation liquid.

12. A method according to claim 1, characterized in that the pressure surges are generated by detonation of an explosive gas.

* * * * *